US005507045A

United States Patent [19]

Shamie

[11] Patent Number: 5,507,045

[45] Date of Patent: Apr. 16, 1996

[54] CRIB WITH TWO TIER HEIGHT ADJUSTMENT LINKAGE MECHANISM

[76] Inventor: Louis Shamie, 972 Dean St., Brooklyn, N.Y. 11238

[21] Appl. No.: 209,121

[22] Filed: Mar. 9, 1994

[51] Int. Cl.[6] ..... A47D 7/03; A47D 7/02

[52] U.S. Cl. ..... 5/93.1

[58] Field of Search ..... 5/93.1, 11, 100

[56] References Cited

U.S. PATENT DOCUMENTS

| | | | |
|---|---|---|---|
| 1,992,733 | 2/1935 | Bayer | 5/11 |
| 2,094,553 | 9/1937 | Shaw | 5/11 |
| 2,206,248 | 7/1940 | Bukolt | 5/11 |
| 2,299,136 | 10/1942 | Feldman | 5/93.1 |
| 2,364,577 | 12/1944 | Webb | 5/93.1 |
| 2,968,817 | 1/1961 | Jacobs et al. | 5/11 |

*Primary Examiner*—Alexander Grosz
*Attorney, Agent, or Firm*—Burgess, Ryan and Wayne

[57] ABSTRACT

A crib includes two opposite end frame members; two opposite drop side members connected with and between the two end frame members; a mattress support for supporting a mattress between the end frame members and the side members, the mattress support being connected to the end frame members and including a substantially rectangular frame positioned between the end frame members and the side members, the frame including two opposite end bars and first and second opposite side bars interconnected with the end bars, each end bar having a first end adjacent the first side bar and a second, opposite end adjacent the second side bar; and a pivoting linkage assembly including two linkage bars, each having a first end pivotally connected to a respective end bar of the frame at a position spaced inwardly of the first end thereof, the first side bar substantially bisecting each linkage bar and resting on the linkage bars in lower and raised stable supporting positions, a connecting rod for fixedly connecting together the second ends of the linkage bars, first and second pivoting support bars for pivotally supporting second, opposite ends of the linkage bars to the end frame members, respectively, and third and fourth pivoting support bars for pivotally supporting the second ends of the end bars to the end frame members, respectively.

17 Claims, 7 Drawing Sheets

CRIB WITH TWO TIER HEIGHT ADJUSTMENT LINKAGE MECHANISM

BACKGROUND OF THE INVENTION

The present invention relates generally to cribs, and more particularly, is directed to a crib having a novel height adjustment mechanism.

Generally, the mattress support for an infant crib includes a rectangular metal frame and wire or rod supports held within the confines of the metal frame by springs. Hooks are pivotally connected to each corner of the metal frame. Each upright support post of the crib has a plurality of generally U- or L-shaped catches secured thereto in spaced, vertical intervals. To adjust the height of the metal frame, and thereby, of the mattress supported thereby, it is necessary to move all four hooks to different catches. This, however, becomes burdensome and time-consuming.

Further, there may be, for example, four or more catches on each upright support post. This adds to the complexity and cost of the crib.

More importantly, only two of the catches are generally necessary. In other words, when the infant is small and cannot stand up, the uppermost catches are engaged by the hooks, and when the infant is older and can stand up in the crib, the lowermost catches are engaged by the hooks. Therefore, the intermediate catches become unnecessary.

OBJECTS AND SUMMARY OF THE INVENTION

Accordingly, it is an object of the present invention to provide a crib with a two tier height adjustment that overcomes the problems with the aforementioned prior art.

It is another object of the present invention to provide a crib with a two tier height adjustment using a pivoting linkage mechanism of the mattress support frame itself.

It is still another object of the present invention to provide a crib with a two tier height adjustment that provides adjustment of the entire mattress support frame with a simple movement of a pivoting linkage mechanism.

It is yet another object of the present invention to provide a crib with a two tier height adjustment that eliminates the need to make four independent adjustments at the corners of the mattress support frame.

In accordance with an aspect of the present invention, a crib includes two opposite end frame members; two opposite drop side members connected with and between the two end frame members; mattress support means for supporting a mattress between the end frame members and the side members; and pivoting linkage means for pivotally supporting the mattress support means from the end frame members such that the mattress support means is capable of assuming only a lower stable supporting position and a raised stable supporting position.

Specifically, in a first embodiment of the invention, the mattress support means includes a substantially rectangular frame positioned between the end frame members and the side members, the frame including two opposite end bars and first and second opposite side bars interconnected with the end bars, each end bar having a first end adjacent the first side bar and a second, opposite end adjacent the second side bar.

The pivoting linkage means includes two linkage bars, each having a first end pivotally connected to a respective end bar of the frame at a position spaced inwardly of the first end thereof, a first set of pivoting support bar means for pivotally supporting second, opposite ends of the linkage bars to the end frame members, respectively, and a second set of pivoting support bar means for pivotally supporting the second ends of the end bars to the end frame members, respectively.

Preferably, the first side bar substantially bisects each linkage bar, and the first side bar rests on the linkage bars in the lower and raised stable supporting positions. In this regard, each linkage bar includes a bend so as to form a depression therein for receiving the first side bar.

Also, a connecting rod is provided for fixedly connecting together the second ends of the linkage bars.

In the second embodiment of the invention, the mattress support means includes a first substantially rectangular frame and a second substantially rectangular frame situated side by side between the end frame members and the side members, each frame including two opposite end bars and interconnecting support bars, each end bar having an outer end and an inner end, with the inner ends of the end bars being adjacent to each other.

The pivoting linkage means includes two channel means for pivotally interconnecting the adjacent inner ends of the end bars together, pivoting support bar means for pivotally supporting the outer ends of the end bars to the end frame members.

A connecting rod fixedly connects together the channel means, and preferably, each channel means has a substantially inverted U-shape.

In accordance with another aspect of the present invention, a crib includes two opposite end frame members; two opposite drop side members connected with and between the two end frame members; mattress support means for supporting a mattress between the end frame members and the side members, the mattress support means including a substantially rectangular frame positioned between the end frame members and the side members, the frame including two opposite end bars and first and second opposite side bars interconnected with the end bars, each end bar having a first end adjacent the first side bar and a second, opposite end adjacent the second side bar; and pivoting linkage means for pivotally supporting the mattress support means from the end frame members such that the mattress support means is capable of assuming only a lower stable supporting position and a raised stable supporting position, the pivoting linkage means including two linkage bars, each having a first end pivotally connected to a respective the end bar of the frame at a position spaced inwardly of the first end thereof, first and second pivoting support bar means for pivotally supporting second, opposite ends of the linkage bars to the end frame members, respectively, and third and fourth pivoting support bar means for pivotally supporting the second ends of the end bars to the end frame members, respectively.

In accordance with another aspect of the present invention, a crib includes two opposite end frame members; two opposite drop side members connected with and between the two end frame members; and mattress support means for supporting a mattress between the end frame members and the side members, the mattress support means being connected to the end frame members, the mattress support means including a first substantially rectangular frame and a second substantially rectangular frame situated side by side between the end frame members and the side members, each frame including two opposite end bars and interconnecting support bars, each end bar having an outer end and an inner end, with the inner ends of the end bars being adjacent to each other; and pivoting linkage means for pivotally supporting the mattress support means from the end frame members such that the mattress support means is capable of assuming only a lower stable supporting position and a raised stable supporting position, the pivoting linkage means including two inverted U-shaped channel means for pivotally interconnecting the adjacent inner ends of the end bars together, connecting rod means for fixedly connecting together the channel means, and pivoting support bar means for pivotally supporting the outer ends of the end bars to the end frame members.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
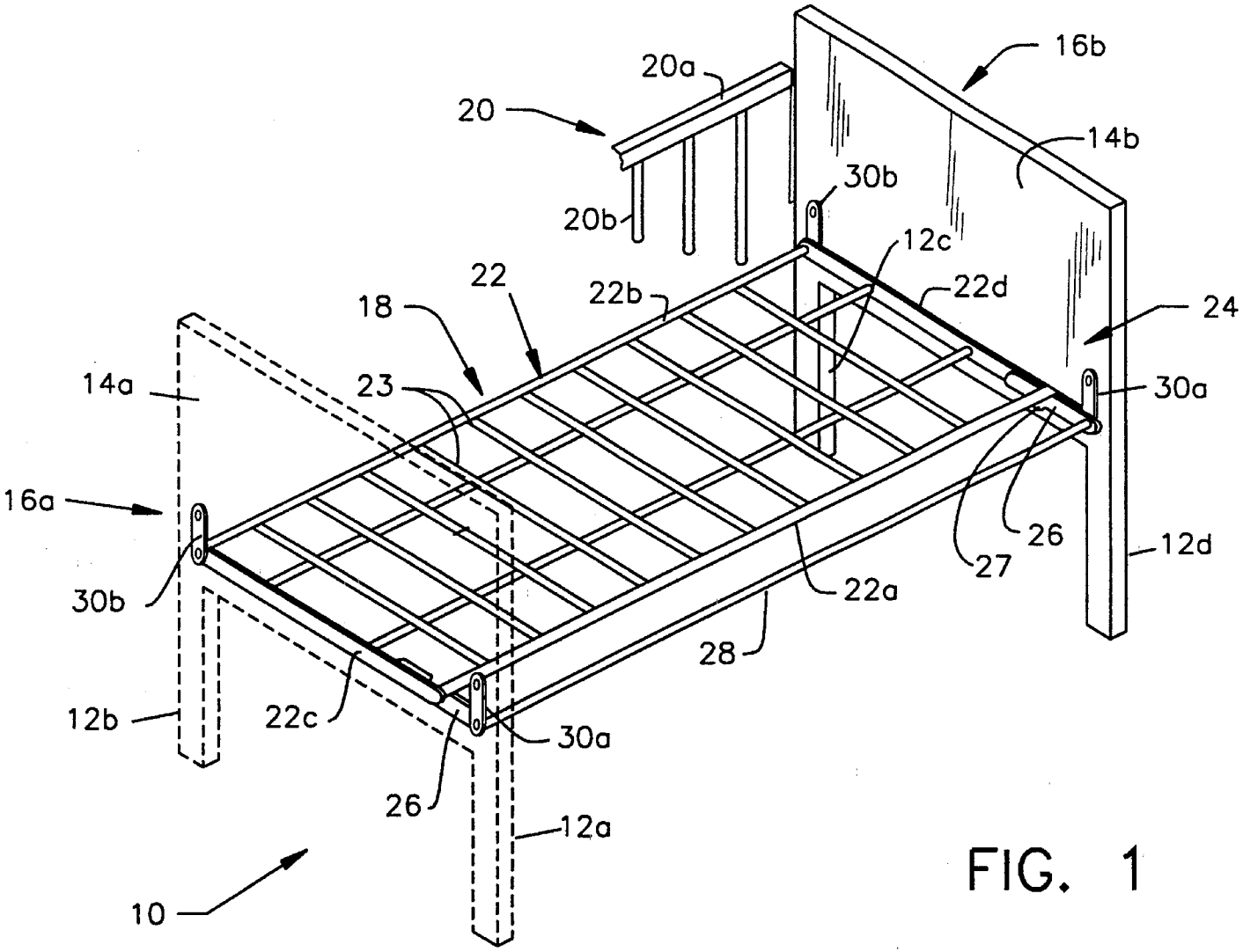
FIG. 1 is a perspective view of a crib with a two tier height adjustment linkage mechanism according to a first embodiment of the present invention, with the mattress support frame in its lowered position.

Referring to the drawings in detail, and initially to FIGS. 1–4 thereof, a crib 10 according to the present invention includes four vertical corner posts 12*a*–12*d*. Two opposite end panels 14*a* and 14*b* are provided, each integrally formed at the upper ends of and between two adjacent corner posts 12*a*, 12*b* and 12*c*, 12*d*, respectively. As a result, an end frame member 16*a* is formed by two vertical corner posts 12*a*, 12*b* and end panel 14*a*, and an end frame member 16*b* is likewise formed by the remaining two vertical corner posts 12*c*, 12*d* and end panel 14*b*.

End frame members 16*a* and 16*b* are retained in a spaced and parallel relation to each other by a mattress support frame 18 which will be described in greater detail hereinafter.

In addition, two drop sides or gates 20 (only one of which is shown) are slidably connected between two adjacent corner posts 12*a*, 12*d* and 12*b*, 12*c*, respectively. The above arrangement, as is conventional, forms the basic framework for a crib. Each drop side 20 includes a horizontally oriented lower rail (not shown), a horizontally oriented upper rail 20*a* and a plurality of vertically oriented bars 20*b* which connect the lower rail and upper rail 20*a* in a parallel, spaced relation, as is well known. The mechanism for permitting vertical sliding movement of drop sides 20 is not shown for the sake of clarity.

In accordance with the present invention, mattress support frame 18 includes a rectangular metal frame 22 formed by metal side bars 22*a* and 22*b*, and metal end bars 22*c* and 22*d*. A plurality of rod, strip or wire supports 23 are connected within and to bars 22*a*–22*d* to form a support matrix.

Crib 10 further includes a linkage mechanism 24 comprised of linkage bars 26, each having one end pivotally connected to an end bar 22*c* or 22*d*, respectively, and being parallel to end bars 22*c* and 22*d*. Specifically, each linkage bar 26 is arranged such that side bar 22*a* effectively bisects linkage bars 26, that is, one-half of each linkage bar 26 extends in parallel overlapping relation with a respective end bar 22*c* or 22*d*, and the other half of each linkage bar 26 extends outwardly from the respective end bar 22*c* or 22*d*.

A mid-portion of each linkage bar 26 is curved so as to form a depression 27 therein. Depressions 27 receive side bar 22*a* therein such that the upper surfaces of side bars 22*a* and 22*b*, end bars 22*c* and 22*d* and linkage bars 26 lie substantially in the same plane, for supporting the mattress thereon. The opposite ends of linkage bars 26 are fixedly connected together by a connecting rod 28.

Further, linkage mechanism 24 includes pivoting support bars 30*a* and 30*b* which pivotally support the four corners of mattress support frame 18 to end panels 14*a* and 14*b*. Specifically, pivoting support bars 30*a* are pivoted at one end to the outer free ends of linkage bars 26, respectively, and are pivoted at the opposite end to end panels 14*a* and 14*b*, respectively. The other two pivoting support bars 30*b* are pivoted at one end to the ends of end bars 22*c* and 22*d* which are adjacent side bar 22*b*, respectively, and are pivoted at the opposite end to end panels 14*a* and 14*b*, respectively.

In the lowered position of mattress support frame 18 which is shown in FIG. 1, pivoting support bars 30*a* and 30*b* hang vertically down from end panels 14*a* and 14*b*. Further, side bar 22*a* rests within depressions 27 so as to exert pressure thereon. As a result, metal frame 22, linkage bars 26 and connecting rod 28 effectively form a unitary frame for supporting a mattress thereon. It will be appreciated that mattress support frame 18 cannot pivotally wobble about pivoting support bars 30*a* and 30*b*, since it is restrained by drop sides 20.

Figure 2:
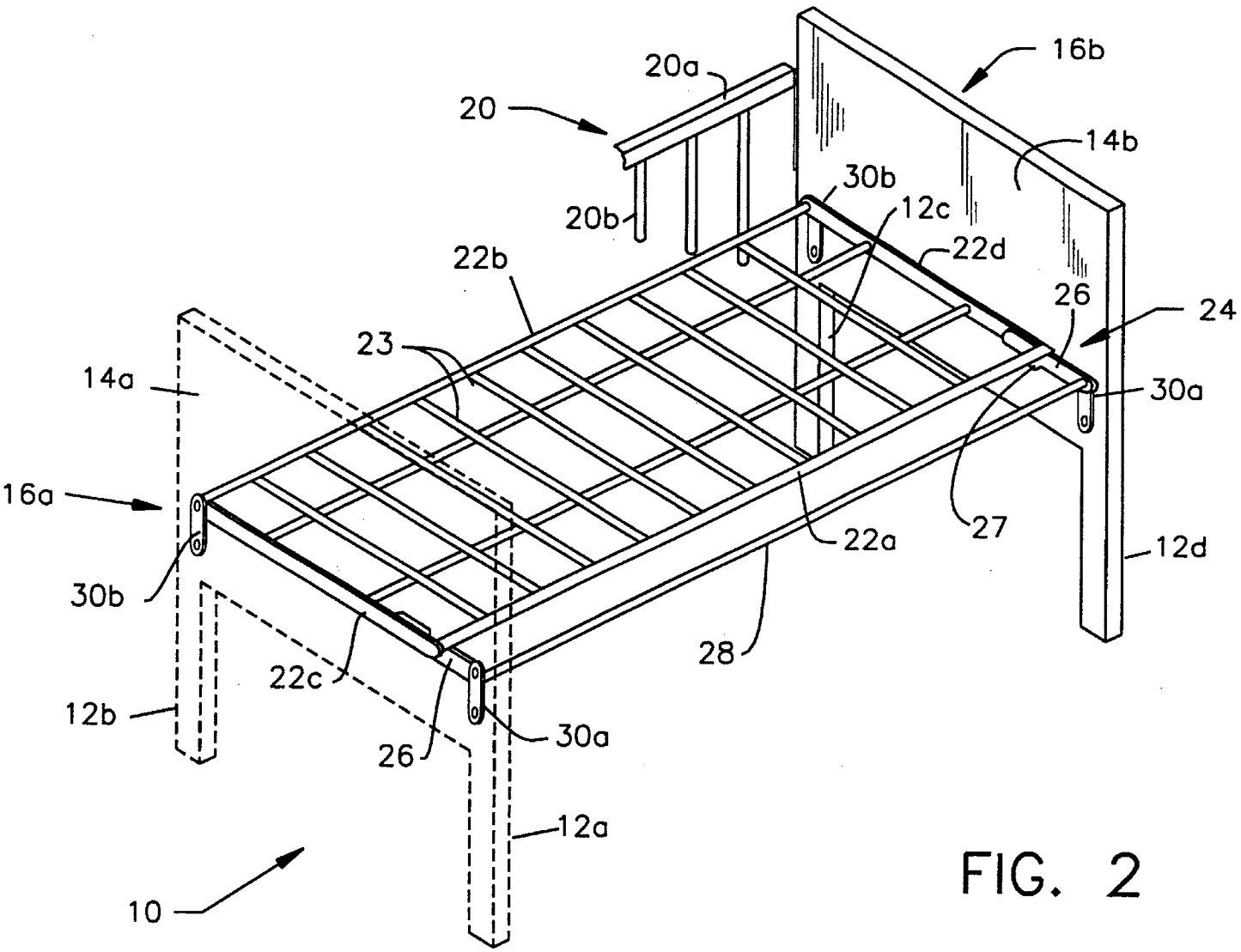
FIG. 2 is a perspective view of a crib with the two tier height adjustment linkage mechanism of FIG. 1, with the mattress support frame in its raised position.
Figure 3:
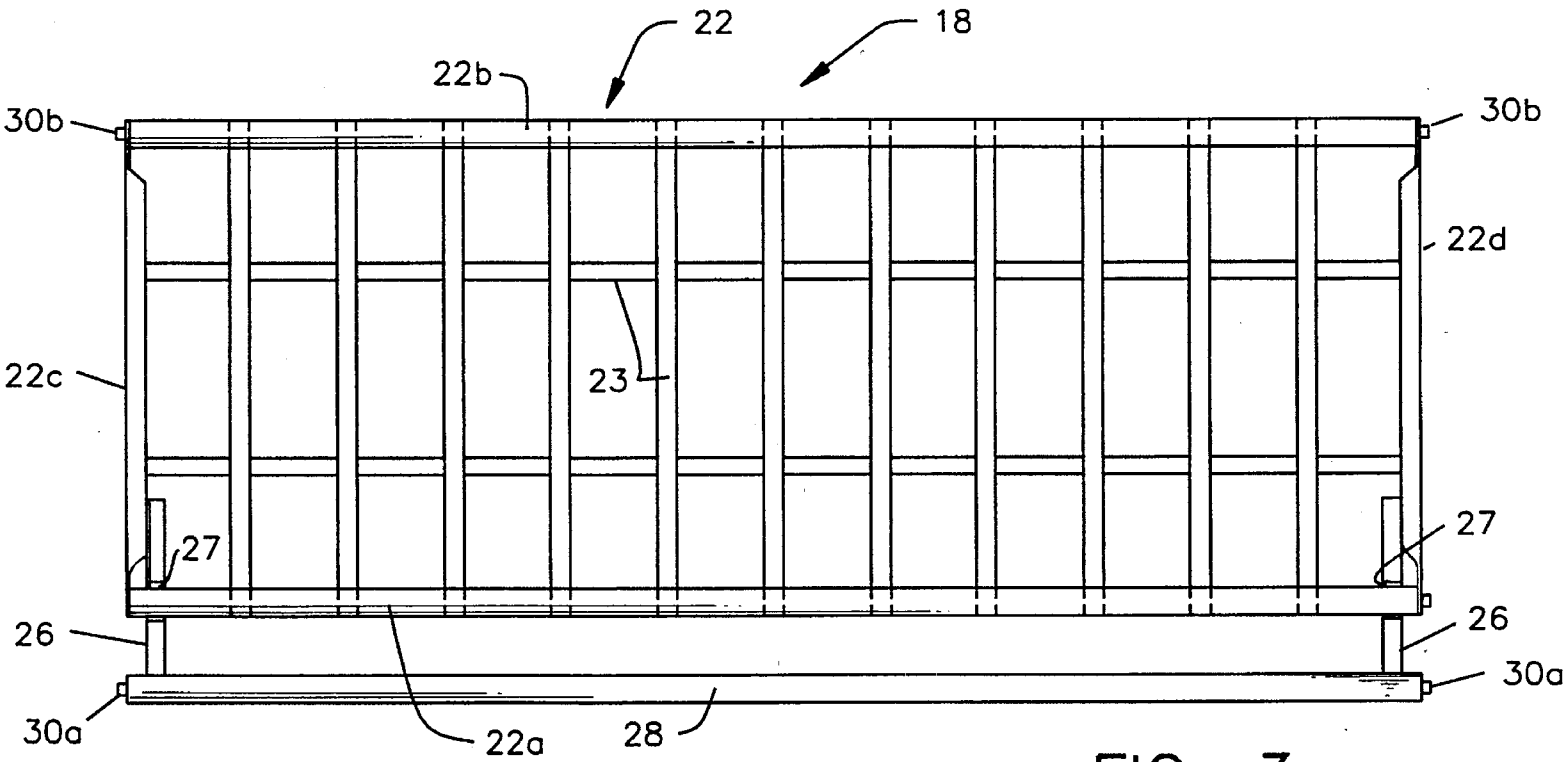
FIG. 3 is a top plan view of the mattress support frame and two tier height adjustment linkage mechanism of FIG. 2.
Figure 4:
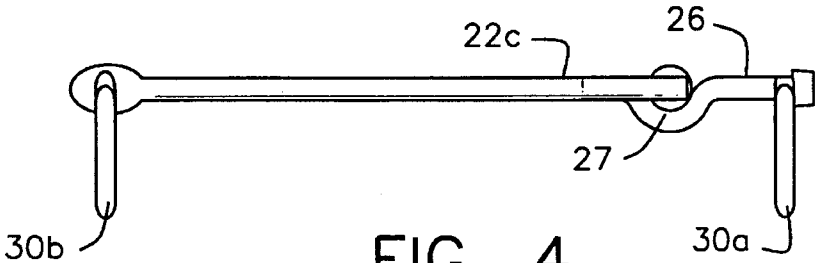
FIG. 4 is a side elevational view of the mattress support frame and two tier height adjustment linkage mechanism of FIG. 3.
Figure 5:
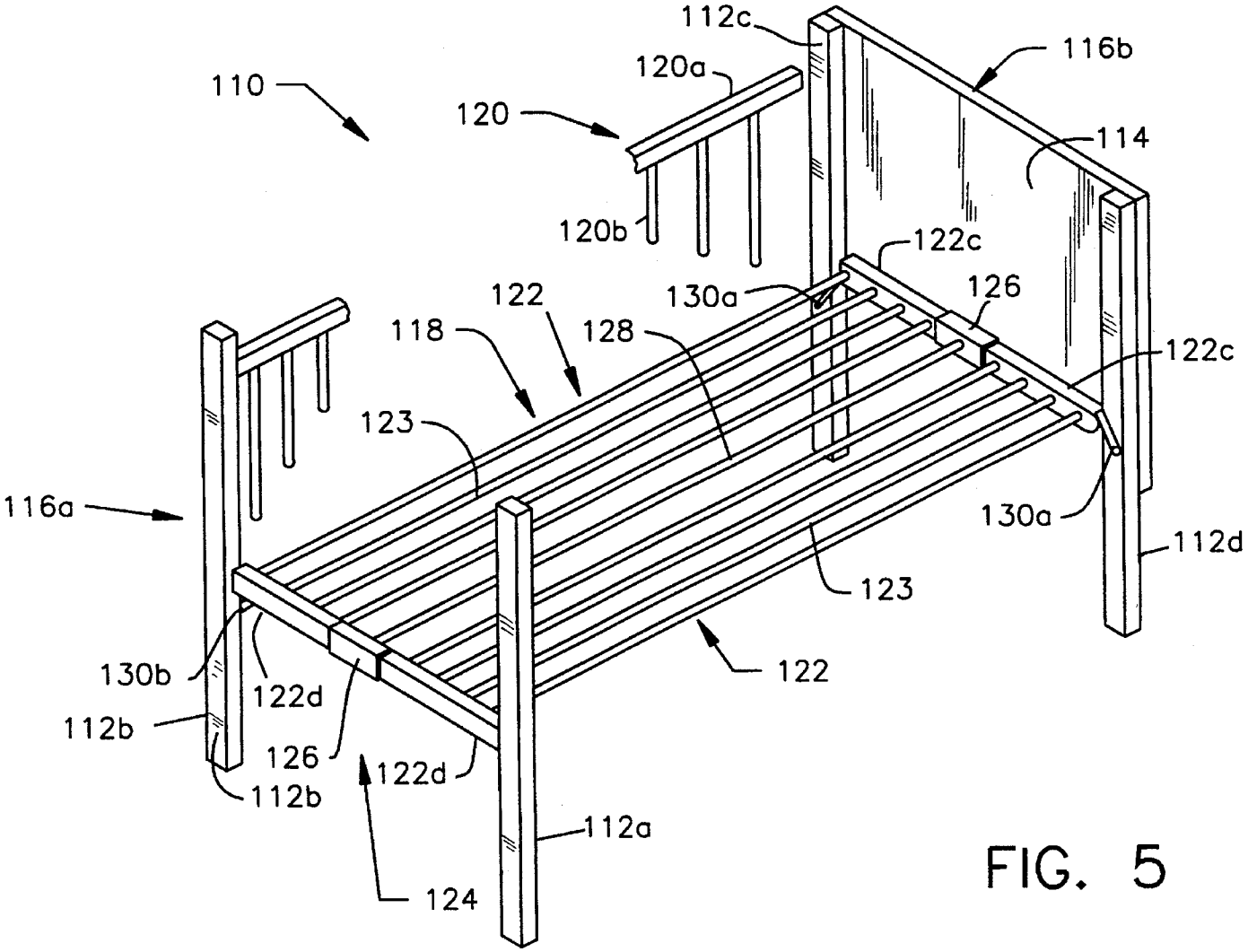
FIG. 5 is a perspective view of a crib with a two tier height adjustment linkage mechanism according to a second embodiment of the present invention, with the mattress support frame in its raised position.
Figure 6:
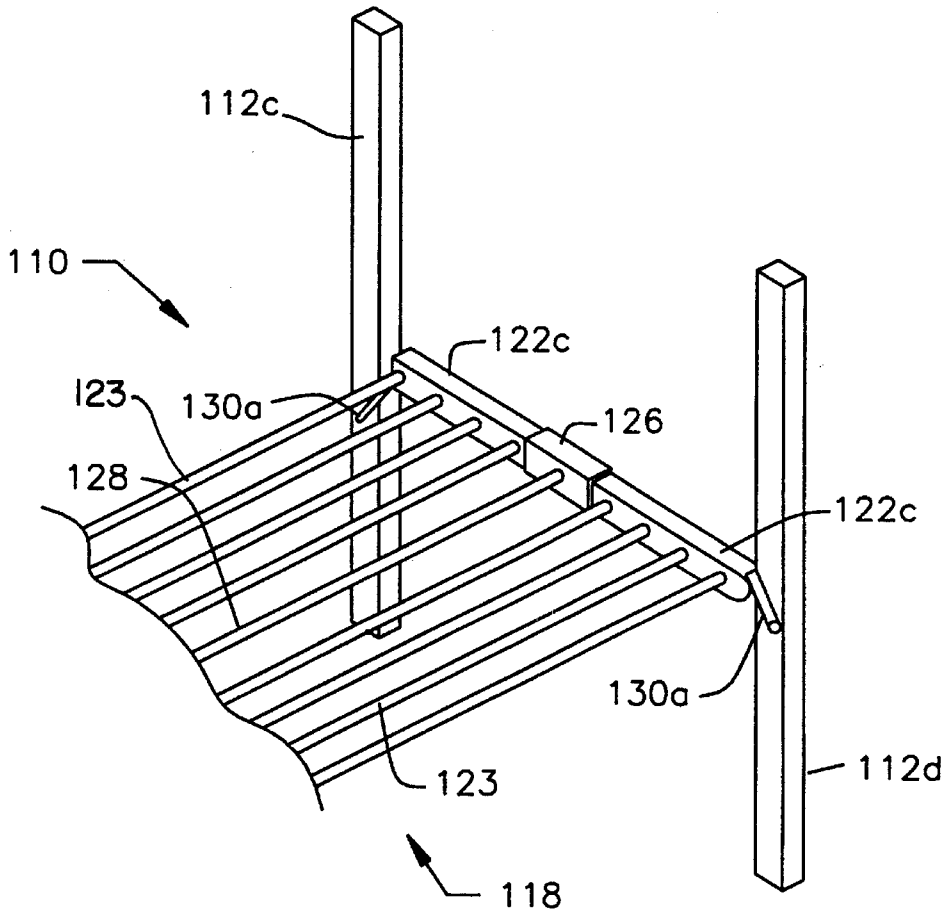
FIG. 6 is an enlarged, perspective view of a portion of the crib with the two tier height adjustment linkage mechanism of FIG. 5.
Figure 7:
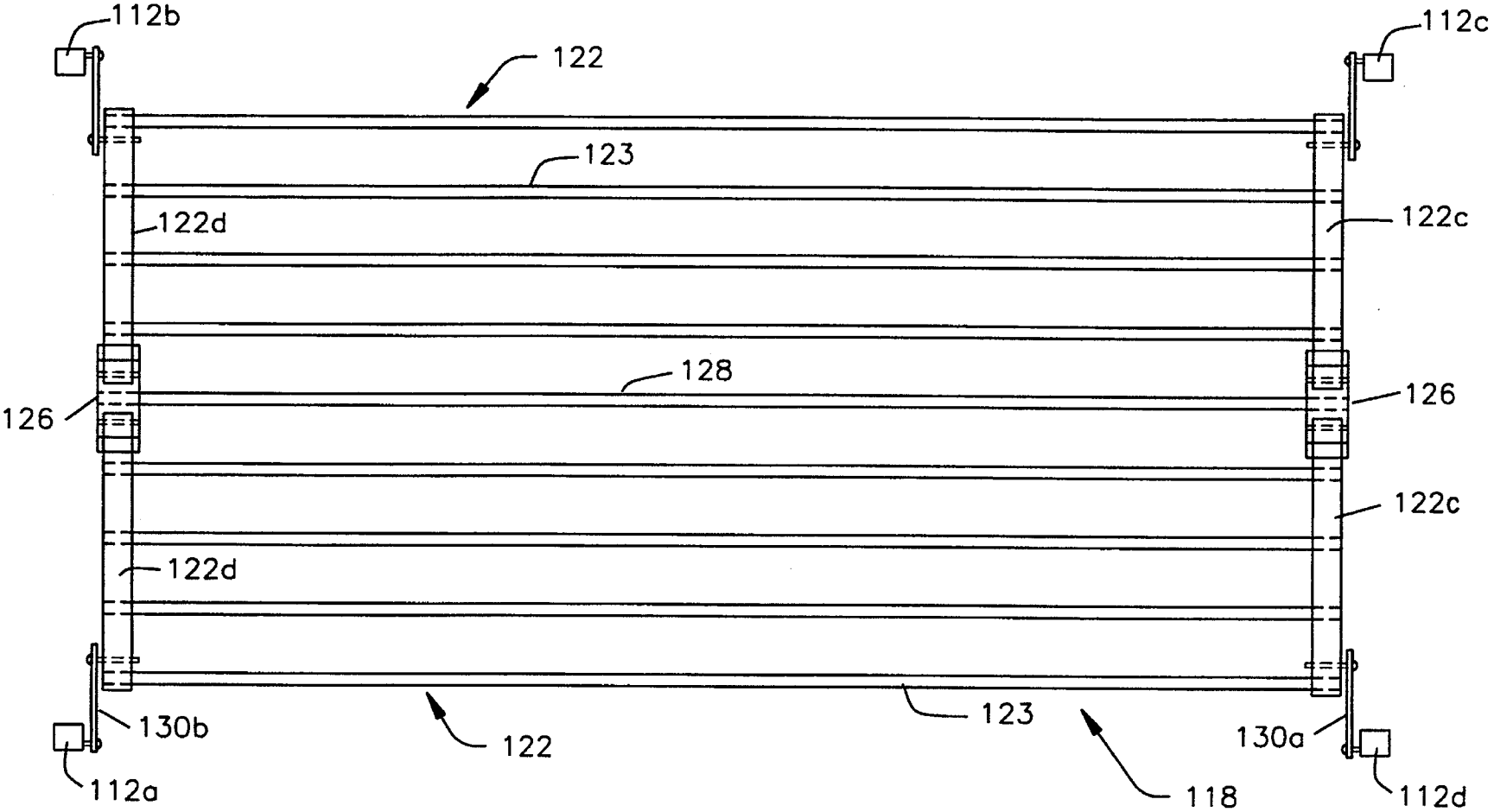
FIG. 7 is a top plan view of the mattress support frame and two tier height adjustment linkage mechanism of FIG. 5.

In order to raise mattress support frame 18 to the raised position of FIGS. 2–4, without removing drop sides 20, the mattress (not shown) is first removed. Then, side bar 22*a* is pulled up and toward its adjacent drop rail 20. This causes pivoting support bars 30*b* to pivot to a horizontal position. Then, the opposite side bar 22*b* is pulled upwardly and toward its adjacent drop side 20 so that pivoting support bars 30*b* are in the vertically raised position of FIG. 2. Thereafter, connecting rod 28 is grasped and pulled upwardly so as to pivot with pivoting support bars 30*a*, whereby pivoting support bars 30*a* are moved to the vertically raised position of FIG. 2. In this position, side bar 22*a* then falls so as to rest within depressions 27. It will be appreciated that mattress support frame 18 cannot pivotally wobble about pivoting support bars 30*a* and 30*b*, since it is restrained by drop sides 20.

It will further be appreciated that the raising of mattress support frame 18 from the position of FIG. 1 to the position of FIG. 2 occurs without removing or lowering drop sides 20. In order to lower mattress support frame 18 from the position of FIG. 2 to the position of FIG. 1, the opposite procedure is performed.

Referring now to FIGS. 5–10, a crib 110 with a two tier height adjustment according to a second embodiment of the present invention will now be described in which elements corresponding to those of the crib 10 of FIGS. 1–4 are identified by the same reference designators, augmented by 100, and a detailed description of the common elements will be omitted for the sake of brevity.

Crib 110, as with crib 10, includes four vertical corner posts 112*a*–112*d* and two opposite end panels 114 secured at the upper ends of two adjacent corner posts 112*a*, 112*b* and 112*c*, 112*d*, respectively, so as to form an end frame member 116*a* by vertical corner posts 112*a*, 112*b* and the corresponding end panel 114, and an end frame member 116*b* by the remaining two vertical corner posts 112*c*, 112*d* and the other end panel (not shown).

End frame members 116*a* and 116*b* are retained in a spaced and parallel relation to each other by a mattress support frame 118 which will be described in greater detail hereinafter.

In addition, two drop sides or gates 120 (only one of which is shown) are slidably connected between two adjacent corner posts 112*a*, 112*d* and 112*b*, 112*c*, respectively. The above arrangement, as is conventional, forms the basic framework for a crib. Each drop side 120 includes a horizontally oriented lower rail (not shown), a horizontally oriented upper rail 120*a* and a plurality of vertically oriented bars 120*b* which connect the lower rail and upper rail 120*a* in a parallel, spaced relation, as is well known. The mechanism for permitting vertical sliding movement of drop sides 120 is not shown for the sake of clarity.

In accordance with the second embodiment of the present invention, mattress support frame 118 includes two rectangular metal frame halves 122, each formed by two spaced, parallel metal end bars 122*c* and 122*d*, and a plurality of lengthwise rod, strip or wire supports 123 connected between and to bars 122*c* and 122*d*.

Crib 110 further includes a linkage mechanism 124 comprised of short end channel members 126 of an inverted U-shape. Each inverted U-shaped channel member 126 is thereby formed with two parallel, spaced apart vertically oriented leg plates, connected together at their upper ends by a connecting plate. Each channel member 126 receives the inner end of each end bar 122*c* and 122*d*, respectively, of the frame halves 122 therewithin, with the inner end of each end bar 122*c* and 122*d* pivotally connected thereto. Thus, channel members 126 function as central pivoting members for frame halves 122. Midpoints of channel members 126 are fixedly connected together by a connecting rod 128.

Further, pivoting support bars 130*a* and 130*b* pivotally support the four corners of mattress support frame 118 to the four vertical corner posts 112*a*–112*d*, respectively. Specifically, pivoting support bars 130*a* are pivoted at one end to the outer ends of end bars 122*c* of one frame half 122, and are pivoted at the opposite end to vertical corner posts 112*c* and 112*d*, respectively. Pivoting support bars 130*b* are pivoted at one end to the outer ends of end bars 122*d* of the other frame half 122, and are pivoted at the opposite end to vertical corner posts 112*b* and 112*a*, respectively.

Figure 8:
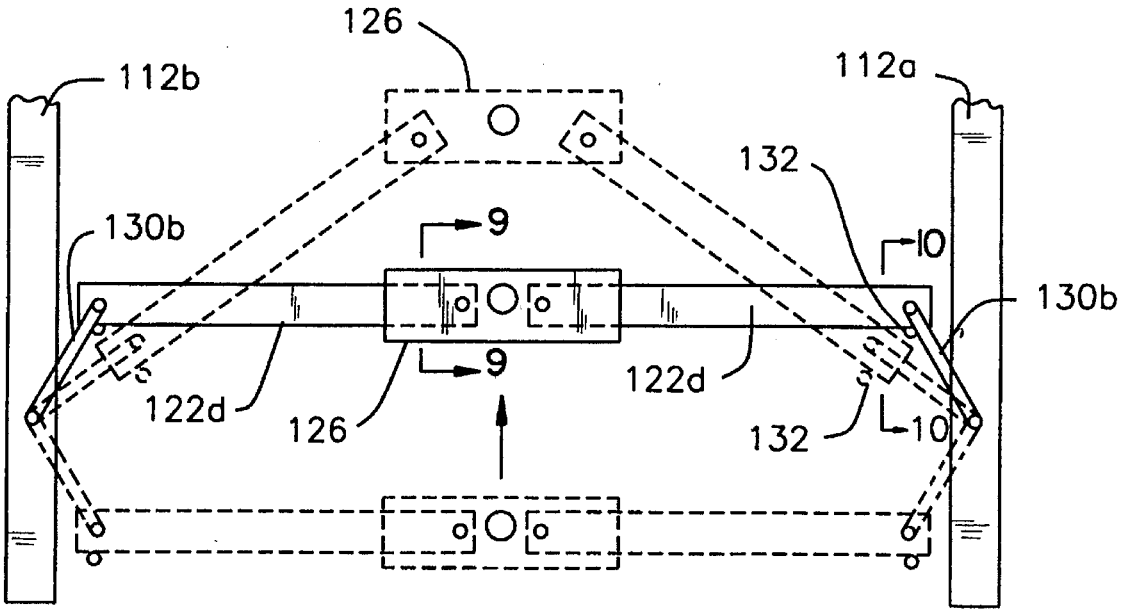
FIG. 8 is a side elevational view of the mattress support frame and two tier height adjustment linkage mechanism of FIG. 5, showing movement of the mattress support frame between its raised and lowered positions.
Figure 9:
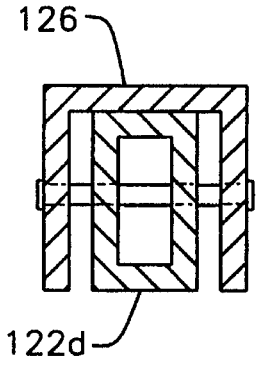
FIG. 9 is a cross-sectional view of the mattress support frame and two tier height adjustment linkage mechanism, taken along line 9—9 of FIG. 8.
Figure 10:
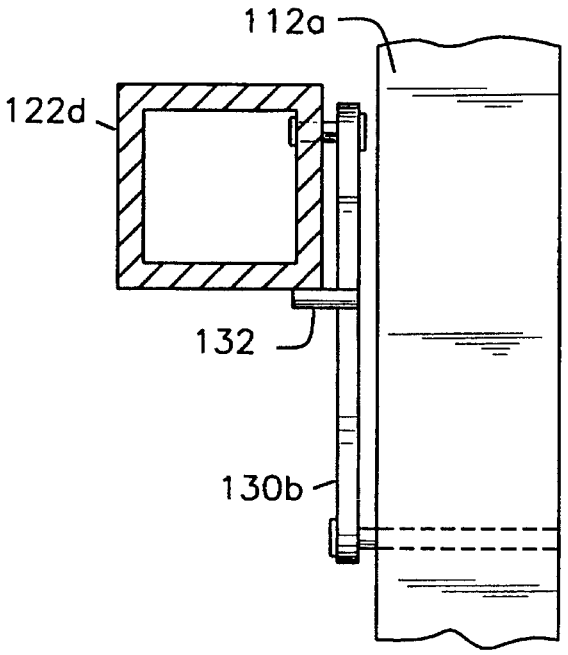
FIG. 10 is a cross-sectional view of the mattress support frame and two tier height adjustment linkage mechanism, taken along line 10—10 of FIG. 8.

In the lowered position of mattress support frame 118 which is shown in dashed lines in FIG. 8, pivoting support bars 130*a* and 130*b* extend downwardly and inwardly from vertical corner posts 112*a*–122*d*. In this position, the inner ends of end bars 122*c* and 122*d* of both frame halves 122 abut against the underside of the connecting leg plates of the channel members 126, as shown best in FIG. 9, so that frame halves 122 lie in a common plane for supporting a mattress thereon. It will be appreciated that mattress support frame 118 cannot pivotally wobble about pivoting support bars 130*a* and 130*b*, since it is restrained by drop sides 120.

In order to raise mattress support frame 118 to the raised position of FIGS. 5–8, without removing drop sides 120, the mattress (not shown) is first removed. Then, connecting rod 128 is pulled vertically up, as shown by the upper dashed lines in FIG. 8. This causes pivoting support bars 130*a* and 130*b* to pivot to a position extending upwardly and inwardly, as shown by the upper dashed lines in FIG. 8. Then, connecting rod 128 is pushed down to the solid position in FIG. 8, which causes pivoting support bars 130*a* and 130*b* to pivot upwardly at a greater angle, so as to position mattress support frame 118 in its raised position. It will be appreciated that mattress support frame 118 cannot pivotally wobble about pivoting support bars 130*a* and 130*b*, since it is restrained by drop sides 120. In addition, the underside of end bars 122*c* and 112*d* are provided with pins 132 which abut against pivoting support bars 130*a* and 130*b* in the raised position only, as best shown in FIG. 8, to further prevent wobbling thereat.

It will further be appreciated that the raising of mattress support frame 118 from the lower dashed line position of FIG. 8 to the solid line position of FIG. 8 occurs without removing or lowering drop sides 120. In order to lower mattress support frame 118, the opposite procedure is performed.

Thus, there is provided a crib with a two tier height adjustment using a pivoting linkage mechanism of the mattress support frame itself, in which adjustment of the entire mattress support frame occurs with a simple movement of a pivoting linkage mechanism. Thus, there is no need to make four independent adjustments at the corners of the mattress support frame, as with known cribs.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A crib comprising:

two opposite end frame members;

two opposite drop side members connected with and between said two end frame members so as to define a rectangular crib frame having four crib corners at connections of said side members to said end frame members;

mattress support means for supporting a mattress between said end frame members and said side members, said mattress support means including at least one rectangular frame having four frame corners; and pivoting linkage means for pivotally supporting said mattress support means from said end frame members such that said mattress support means is capable of assuming only a stable supporting horizontal position in a lower supporting position and a raised supporting position, said pivoting linkage means including:

four pivoting support bars, each pivotally supporting one said frame corner to the adjacent said crib corner, and linkage assembly means, different from said pivoting support bars and connected with said frame, for permitting raising of one lengthwise side of said at least one rectangular frame to a higher position than another lengthwise side of said at least one rectangular frame in order to angle said at least one rectangular frame in a widthwise direction thereof relative to said horizontal position to enable said frame to move between said lower horizontal supporting position and said raised horizontal supporting position.

2. A crib according to claim 1, wherein there is only one said frame which includes two opposite end bars and first and second opposite side bars interconnected with said end bars, each said end bar having a first end adjacent said first side bar and a second, opposite end adjacent said second side bar.

3. A crib according to claim 2, wherein said linkage assembly means includes:

two linkage bars, each having a first end pivotally connected to a respective end bar of said frame at a position spaced inwardly of said first end of said respective end bar of said frame and a second, opposite end pivotally supported by one said pivoting support bar, and the remaining two pivoting support bars pivotally supporting said second ends of said end bars to said end frame members, respectively.

4. A crib according to claim 3, wherein said first side bar substantially bisects each said linkage bar.

5. A crib according to claim 3, wherein said first side bar rests on said linkage bars in said lower and raised stable supporting positions.

6. A crib according to claim 5, wherein each said linkage bar includes a bend so as to form a depression therein for receiving said first side bar.

7. A crib according to claim 3, further including connecting rod means for fixedly connecting together said second ends of said linkage bars.

8. A crib comprising:

two opposite end frame members;

two opposite drop side members connected with and between said two end frame members;

mattress support means for supporting a mattress between said end frame members and said side members, said mattress support means including a first substantially rectangular frame and a second substantially rectangular frame situated side by side between said end frame members and said side members, each said frame including two opposite end bars and interconnecting support bars, each said end bar having an outer end and an inner end, with said inner ends of said end bars being adjacent to each other; and pivoting linkage means for pivotally supporting said mattress support means from said end frame members such that said mattress support means is capable of assuming only a lower stable supporting position and a raised stable supporting position.

9. A crib according to claim 8, wherein said pivoting linkage means includes:

two channel means for pivotally interconnecting said adjacent inner ends of said end bars together, pivoting support bar means for pivotally supporting the outer ends of said end bars to said end frame members.

10. A crib according to claim 9, further including connecting rod means for fixedly connecting together said channel means.

11. A crib according to claim 9, wherein each said channel means has a substantially inverted U-shape.

12. A crib comprising:

two opposite end frame members;

two opposite drop side members connected with and between said two end frame members;

mattress support means for supporting a mattress between said end frame members and said side members, said mattress support means including a substantially rectangular frame positioned between said end frame members and said side members, said frame including two opposite end bars and first and second opposite side bars interconnected with said end bars, each said end bar having a first end adjacent said first side bar and a second, opposite end adjacent said second side bar; and pivoting linkage means for pivotally supporting said mattress support means from said end frame members such that said mattress support means is capable of assuming only a lower stable supporting position and a raised stable supporting position, said pivoting linkage means including:

two linkage bars, each having a first end pivotally connected to a respective said end bar of said frame at a position spaced inwardly of said first end thereof, first and second pivoting support bar means for pivotally supporting second, opposite ends of said linkage bars to said end frame members, respectively, and third and fourth pivoting support bar means for pivotally supporting said second ends of said end bars to said end frame members, respectively.

13. A crib according to claim 12, wherein said first side bar substantially bisects each said linkage bar.

14. A crib according to claim 12, wherein said first side bar rests on said linkage bars in said lower and raised stable supporting positions.

15. A crib according to claim 14, wherein each said linkage bar includes a bend so as to form a depression therein for receiving said first side bar.

16. A crib according to claim 12, further including connecting rod means for fixedly connecting together said second ends of said linkage bars.

17. A crib comprising:

two opposite end frame members;

two opposite drop side members connected with and between said two end frame members; and mattress support means for supporting a mattress between said end frame members and said side members, said mattress support means being connected to said end frame members, said mattress support means including a first substantially rectangular frame and a second substantially rectangular frame situated side by side between said end frame members and said side members, each said frame including two opposite end bars and interconnecting support bars, each end bar having an outer end and an inner end, with said inner ends of said end bars being adjacent to each other; and pivoting linkage means for pivotally supporting said mattress support means from said end frame members such that said mattress support means is capable of assuming only a lower stable supporting position and a raised stable supporting position, said pivoting linkage means including:

two inverted U-shaped channel means for pivotally interconnecting said adjacent inner ends of said end bars together, connecting rod means for fixedly connecting together said channel means, and pivoting support bar means for pivotally supporting the outer ends of said end bars to said end frame members.

* * * * *